US012357017B2

(12) United States Patent
Ishikawa et al.

(10) Patent No.: US 12,357,017 B2
(45) Date of Patent: Jul. 15, 2025

(54) TOBACCO FILLING FOR NON-COMBUSTION-TYPE HEATING SMOKING ARTICLE

(71) Applicant: JAPAN TOBACCO INC., Tokyo (JP)

(72) Inventors: Nobuyuki Ishikawa, Tokyo (JP); Masayuki Tsuji, Tokyo (JP); Kei Sadakari, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 56 days.

(21) Appl. No.: 17/903,774

(22) Filed: Sep. 6, 2022

(65) Prior Publication Data

US 2022/0408784 A1 Dec. 29, 2022

Related U.S. Application Data

(60) Division of application No. 16/200,035, filed on Nov. 26, 2018, now abandoned, and a continuation of (Continued)

(51) Int. Cl.
*A24B 15/12* (2006.01)
*A24B 13/02* (2006.01)

(Continued)

(52) U.S. Cl.
CPC ..... *A24B 15/12* (2013.01); *A24B 13/02* (2013.01); *A24B 15/28* (2013.01); *A24B 15/287* (2013.01);

(Continued)

(58) Field of Classification Search
None
See application file for complete search history.

(56) References Cited

U.S. PATENT DOCUMENTS 3,886,954 A * 6/1975 Hannema ..... A24F 13/16 131/175
3,958,580 A 5/1976 Mergens et al.

(Continued)

FOREIGN PATENT DOCUMENTS

CN 1175623 A 3/1998
CN 101485490 A 7/2009

(Continued)

OTHER PUBLICATIONS

Baba, Shintaro, "Machine translation of WO 2011105418", Translated Sep. 22, 2020, Espacenet.com. (Year: 2020).

(Continued)

*Primary Examiner* — Philip Y Louie
*Assistant Examiner* — Sonny V Nguyen
(74) *Attorney, Agent, or Firm* — Birch, Stewart, Kolasch & Birch, LLP

(57) ABSTRACT

The purpose of the present invention is to provide a tobacco filling: that is for a non-combustion-type heating smoking article that heats a filling that contains cut tobacco; that suppresses reductions in the evaporated amount of a fragrant smoke flavor component for the non-combustion-type heating smoking article; and that can suppress the "feeling that fragrant smoke flavor is being inhibited." According to the present invention, a dihydrogen salt of a trivalent or tetravalent acid that has a first acid dissociation constant of 1.0 or lower is added to a tobacco filling, and, as a result, reductions in the evaporated amount of a fragrant smoke flavor component can be suppressed, as can "the feeling that fragrant smoke flavor is being inhibited."

10 Claims, 4 Drawing Sheets

Related U.S. Application Data application No. PCT/JP2016/065720, filed on May 27, 2016.

(51) Int. Cl.

| | |
|---|---|
| ***A24B 15/28*** | (2006.01) |
| ***A24B 15/30*** | (2006.01) |
| ***A24F 40/20*** | (2020.01) |
| *A24F 40/10* | (2020.01) |

(52) U.S. Cl.

CPC ..... *A24B 15/30* (2013.01); *A24F 40/10* (2020.01); *A24F 40/20* (2020.01)

(56) References Cited

U.S. PATENT DOCUMENTS

| | | | | |
|---|---|---|---|---|
| 4,117,850 | A | 10/1978 | Wood | |
| 4,286,606 | A | 9/1981 | Swain et al. | |
| 4,776,353 | A * | 10/1988 | Lilja | A24B 15/18 131/273 |
| 4,936,920 | A | 6/1990 | Keritsis et al. | |
| 5,143,097 | A | 9/1992 | Stephen Sohn et al. | |
| 5,339,838 | A | 8/1994 | Young et al. | |
| 5,529,078 | A * | 6/1996 | Rehder | A24F 13/00 131/206 |
| 5,713,376 | A | 2/1998 | Berger | |
| 6,408,856 | B1 | 8/2002 | McAdam | |
| 2003/0154991 | A1* | 8/2003 | Fournier | A24F 40/50 131/194 |
| 2006/0254606 | A1 | 11/2006 | Fazlani | |
| 2008/0216854 | A1* | 9/2008 | Nicholls | A24B 3/14 131/372 |
| 2009/0151717 | A1 | 6/2009 | Bowen et al. | |
| 2009/0230117 | A1 | 9/2009 | Fernando et al. | |
| 2010/0300463 | A1 | 12/2010 | Chen et al. | |
| 2011/0048434 | A1 | 3/2011 | Chen et al. | |
| 2011/0104218 | A1 | 5/2011 | Karles et al. | |
| 2011/0220130 | A1 | 9/2011 | Mua et al. | |
| 2011/0232657 | A1 | 9/2011 | Karles et al. | |
| 2012/0055494 | A1 | 3/2012 | Hunt et al. | |
| 2013/0152953 | A1 | 6/2013 | Mus et al. | |
| 2014/0345631 | A1 | 11/2014 | Bowen et al. | |
| 2014/0345635 | A1 | 11/2014 | Rabinowitz et al. | |
| 2015/0020820 | A1 | 1/2015 | Figueroa | |
| 2015/0237911 | A1 | 8/2015 | Sha et al. | |
| 2015/0344456 | A1 | 12/2015 | Dull et al. | |
| 2016/0066617 | A1* | 3/2016 | Yilmaz | A24B 9/00 131/309 |
| 2016/0345621 | A1 | 12/2016 | Li et al. | |
| 2017/0042216 | A1 | 2/2017 | Gouinguene et al. | |
| 2018/0310608 | A1 | 11/2018 | Sciboz et al. | |

FOREIGN PATENT DOCUMENTS

| | | | |
|---|---|---|---|
| CN | 102754913 | A | 10/2012 |
| CN | 103564658 | A | 2/2014 |
| CN | 104770885 | A | 7/2015 |
| EP | 0 407 792 | A2 | 1/1991 |
| EP | 0 545 186 | A2 | 6/1993 |
| EP | 1723858 | A1 | 11/2006 |
| EP | 2 540 172 | A1 | 1/2013 |
| GB | 2203022 | A | 10/1988 |
| JP | S62-501050 | A | 4/1987 |
| JP | 2011-505874 | A | 3/2011 |
| JP | 2012-528593 | A | 11/2012 |
| JP | 2013-513399 | A | 4/2013 |
| JP | 2014-198044 | A | 10/2014 |
| WO | WO 2011/105418 | A1 | 9/2011 |
| WO | WO 2014/190079 | A2 | 11/2014 |
| WO | WO 2015/000974 | A1 | 1/2015 |
| WO | WO 2015/101651 | A1 | 7/2015 |

OTHER PUBLICATIONS

English translation of International Search Report mailed Jul. 26, 2016, in PCT/JP2016/065717.

Eurasian Office Action for Eurasian Application No. 201892756, dated Dec. 3, 2020, with an English translation.

Extended European Search Report issued Nov. 21, 2019, in European Patent Application No. 16903170.5.

Extended European Search Report, dated Nov. 21, 2019, for European Application No. 16903167.1.

Gomez-Guillen et al., "The effect of washing water paramters (pH, hardness and sodium pyrophosphate content) on the water-holding capacity and gelation characteristics of sardine (*Sardina pilchardus*) mince," Z Lebensm Unters Forsch A (1997), vol. 204, pp. 13-20.

International Search Report for PCT/JP2016/065720 (PCT/ISA/210) mailed on Jul. 26, 2016.

Libre Texts, "Acid Dissociation Constants at 25 C," Updated Aug. 29, 2019, chem.libretexts.org. (Year: 2019).

Office Action issued Apr. 24, 2020, in Korean Patent Application No. 10-2018-7033391.

Office Action issued Jun. 23, 2020, in Japanese Patent Application No. 2018-518911.

Office Action issued on Jan. 22, 2018 for Taiwanese Patent Application No. 105116860.

Office Action issued on Sep. 21, 2017 for Taiwanese Patent Application No. 105116860.

Office Action issued Sep. 21, 2017, in Taiwan Patent Application No. 105116859, with English translation.

U.S. Office Action for U.S. Appl. No. 16/200,239, dated Dec. 27, 2021.

U.S. Office Action for U.S. Appl. No. 16/200,239, dated Jun. 1, 2021.

Written Opinion of the International Searching Authority for PCT/JP2016/065720 (PCT/ISA/237) mailed on Jul. 26, 2016.

Written Opinion of the International Searching Authority mailed Jul. 26, 2016, in PCT/JP2016/065717, with English translation.

Munro et al., "Safety Evaluations of Specific Food Additives (other than flavouring agents)", Beeswax, Accessed Jul. 11, 2022, https://inchem.org/documents/jecfa/jecmono/v56je02.pdf, pp. 1-14, 2022.

U.S. Ofice Action for U.S. Appl. No. 16/200,239, dated Jul. 15, 2022.

Wikipedia.org, "List of saturated fatty acids", Accessed Jul. 8, 2022, https://en.wikipedia.org/wiki/List_of_saturated_fatty_acid, 2022, 3 pages.

Deroux et al., "Chemical study of the Carnauba (*Copernicia cerifera* Martius) wax," Revista CENIC: Ciencias Químicas, vol. 34, Issue 2, 2003, 9 pages total.

U.S. Office Action for U.S. Appl. No. 16/200,239, dated Sep. 13, 2023.

* cited by examiner

TOBACCO FILLING FOR NON-COMBUSTION-TYPE HEATING SMOKING ARTICLE

CROSS REFERENCE TO RELATED APPLICATIONS

This application is a Divisional application of co-pending application Ser. No. 16/200,035, filed on Nov. 26, 2018, which is a Continuation application of International Application No. PCT/JP2016/065720, filed on May 27, 2016, all of which are hereby expressly incorporated by reference into the present application.

TECHNICAL FIELD

The present invention relates to a tobacco filler for a non-combustion smoking article that fills a non-combustion smoking article for use.

BACKGROUND ART

In recent years, non-combustion smoking articles that replace cigarettes and allow experience of a smoke flavor without combusting tobacco have been developed, and one in which a smoke flavor component and a component capable of generating aerosol fill a pod-shaped container for use or one having a heat source at a tip thereof is typically known.

Addition of acids or capsules containing acids to fillers in such non-combustion smoking articles have also been reported (see Patent Literature 1 to 5).

CITATION LIST

Patent Literature

[Patent Literature 1] WO 2014/190079
[Patent Literature 2] U.S. Patent Application Publication No. 2015/0020820 (Specification)
[Patent Literature 3] U.S. Patent Application Publication No. 2014/0345631
[Patent Literature 4] WO 2015/101651
[Patent Literature 5] WO 2015/000974

SUMMARY OF INVENTION

Technical Problem

During smoking with non-combustion smoking articles, the amount of evaporation of smoke flavor components may be insufficient compared to that from cigarettes or a user may feel so-called "smoke flavor inhibition".

An object of the present invention is to provide a tobacco filler for a non-combustion smoking article that can suppress a reduction in an amount of evaporated smoke flavor components and suppress "smoke flavor inhibition" in a non-combustion smoking article, particularly a smoking article in which a filler containing shredded tobacco is heated.

Solution to Problem

The inventors of the present invention carried out an extensive study in order to solve the problem and, as a result, found that by adding a salt fulfilling specific conditions to a tobacco filler, a reduction in the amount of evaporated smoke flavor components may be suppressed and "smoke flavor inhibition" may be suppressed, thereby completing the present invention.

Thus, the present invention is as follows.

<1> A tobacco filler for a non-combustion smoking article containing a shredded tobacco and a liquid that generates aerosol, wherein the tobacco filler contains a dihydrogen salt of a trivalent or quadrivalent acid having a first acid dissociation constant of 1.0 or less.

<2> The tobacco filler according to <1>, wherein the dihydrogen salt is a dihydrogen salt of pyrophosphoric acid.

<3> The tobacco filler according to <1> or <2>, containing the dihydrogen salt at 0.1% by mass to 10% by mass inclusive of the whole tobacco filler.

<4> The tobacco filler according to any of <1> to <3>, wherein the liquid that generates aerosol contains propylene glycol (PG).

<5> The tobacco filler according to any of <1> to <4>, containing water at 5.0% by mass to 30% by mass inclusive of the whole tobacco filler.

Advantageous Effects of Invention

According to the present invention, a reduction in the amount of evaporated smoke flavor components may be suppressed and "smoke flavor inhibition" may be suppressed in a non-combustion smoking article in which a filler containing shredded tobacco is heated.

DESCRIPTION OF EMBODIMENT

Figure 1:
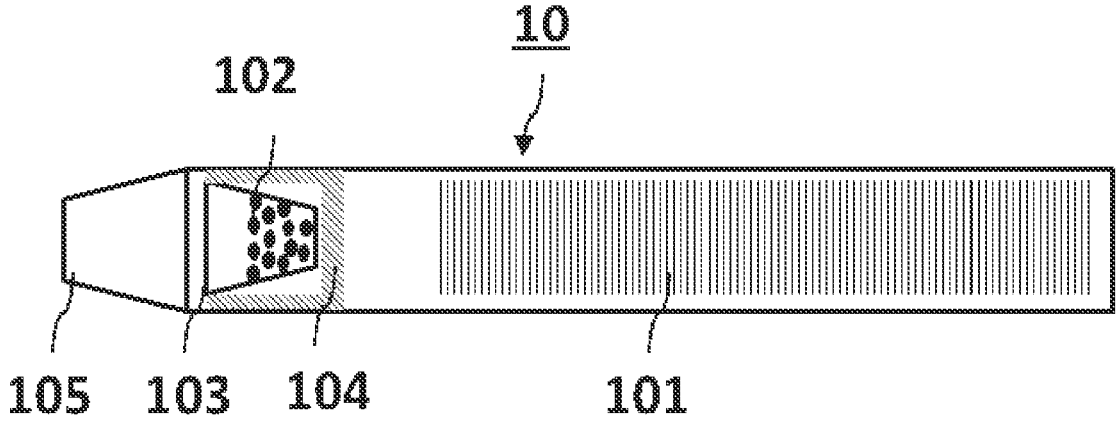
FIG. 1 is a section view illustrating an example of a non-combustion smoking article.

The present invention is described by way of specific examples. However, the present invention is not limited to the following content, and may be appropriately modified and practiced without departing from the scope of the present invention.

<Tobacco Filler for a Non-Combustion Smoking Article>

The tobacco filler (hereinafter abbreviated as "tobacco filler of the present invention") for a non-combustion smoking article according to one embodiment of the present invention contains shredded tobacco and liquid that generates aerosol, and is characterized in that the tobacco filler contains a dihydrogen salt of a trivalent or quadrivalent acid having a first acid dissociation constant of 1.0 or less.

The inventors of the present invention have revealed various issues on non-combustion smoking articles, particularly smoking articles in which a filler containing shredded tobacco is heated.

For example, when an acid is added to a filler (which generally contains liquid that generates aerosol) containing shredded tobacco, the amount of evaporated smoke flavor components may be reduced. This may be caused by penetration of added acid into shredded tobacco together with liquid that generates aerosol and formation of salts with smoke flavor components in shredded tobacco. In non-combustion smoking articles which are heated to high temperature, salts may be dissociated by heating or a reduction in the amount of evaporated smoke flavor components may be suppressed due to high temperature, while the influences may be significant in non-combustion smoking articles which are heated to low temperature. Addition of an acid encapsulated in a capsule may be not preferable in terms of production cost.

Further, during smoking using non-combustion smoking articles, users may feel "smoke flavor inhibition" such as receiving a stimulus that is different from tobacco or generating physiological spontaneous actions such as "choking". This may be caused by components that inhibit smoke flavor in a filler, and volatilization of the components together with solvents such as propylene glycol may cause "smoke flavor inhibition".

The inventors of the present invention found that by adding a salt that generates an acid after dissociation with water or the like contained in a filler rather than directly adding an acid, the acid exhibits the effect thereof without forming salts between the acid and smoke flavor components in shredded tobacco. In order to avoid formation of salts between a dissociated acid and smoke flavor components, it is required that the acid is thermally vaporized at the time of hydrolysation of the acid salt. The inventors of the present invention revealed that the acid formed by dissociation is a strong acid and it is preferable that the salt is formed with a conjugate base of the strong acid. Namely, the inventors of the present invention found that by adding a "dihydrogen salt of a trivalent or quadrivalent acid having a first acid dissociation constant of 1.0 or less" to a tobacco filler, a reduction in the amount of evaporated smoke flavor components may be suppressed and "smoke flavor inhibition" may be suppressed.

The "first acid dissociation constant" means an acid dissociation constant in water at normal temperature (25° C.).

The "non-combustion smoking article", "shredded tobacco", "liquid that generates aerosol", "dihydrogen salt of a trivalent or quadrivalent acid having a first acid dissociation constant of 1.0 or less" and the like are hereinafter specifically described.

The tobacco filler of the present invention is a tobacco filler for a non-combustion smoking article containing shredded tobacco, and liquid that generates aerosol. The non-combustion smoking article which is filled with the tobacco filler of the present invention is not particularly limited as to the specific structure and the like thereof, and may appropriately be any well-known non-combustion smoking article. The non-combustion smoking article is hereinafter described by way of specific examples.

Examples of the non-combustion smoking article include the one that has the structure as a non-combustion smoking article 10 illustrated in FIG. 1. FIG. 1 is a section view of the cylindrical non-combustion smoking article along the longitudinal direction. The non-combustion smoking article 10 has the structure having a battery 101, a pod 103 that accommodates a filler 102, a heater 104, and a mouthpiece 105. By filling the pod 103 with the tobacco filler of the present invention and heating the same, aerosol is generated.

The heating temperature of the tobacco filler in the non-combustion smoking article is generally 22° C. or higher, preferably 100° C. or higher and more preferably 150° C. or higher, and generally 350° C. or lower, preferably 300° C. or lower and more preferably 250° C. or lower. The non-combustion smoking article having a heating temperature of a tobacco filler within the above range tends to have an issue of "smoke flavor inhibition", and thus characteristics of the tobacco filler of the present invention may be more efficiently exploited.

Examples of the type of the shredded tobacco include flue-cured tobacco, Burley tobacco, Japanese domestic tobacco, regenerated tobacco and the like. Examples of the region used include the leaf (expanded tobacco), stem, rib (cut stem), root, flower and the like.

The dimension of the shredded tobacco is not particularly limited. The shredded tobacco preferably has a sphere equivalent diameter of generally 1.5 mm or less and preferably 0.5 mm or less and generally 0.01 mm or more as measured by a projected sectiona1-area method (such as the method using Camsizer (Retsch Technology GmbH)).

The tobacco filler of the present invention contains shredded tobacco at generally 20% by mass or more, preferably 30% by mass or more and more preferably 40% by mass or more, and generally 80% by mass or less, preferably 70% by mass or less and more preferably 60% by mass or less. The content within the above range allows easier suppression of a reduction in the amount of evaporated smoke flavor components and more effective suppression of "smoke flavor inhibition".

Examples of the liquid that generates aerosol include polyhydric alcohols such as glycerol, propylene glycol, triethylene glycol and tetraethylene glycol; aliphatic esters of carboxylic acids such as methyl stearate, dimethyl dodecanedioate and dimethyl tetradecaneaioate and the like. The liquid used is not limited to one type and may be a combination of two or more.

The liquid that generates aerosol preferably contains propylene glycol. Propylene glycol is used for food and medicinal, products as a highly safe solution and can easily generate visible smoke because of the low boiling point and liability of vaporisation Meanwhile, propylene glycol has high vapour pressure, and thus is liable to volatilise in the oral cavity. Because of this, propylene glycol may create an atmosphere in which components inhibiting smoke flavor contained in aerosol are liable to volatilise, thereby more easily causing an issue of "smoke flavor inhibition". Consequently, characteristics of the tobacco filler of the present invention may be more efficiently exploited.

The tobacco filler of the present invention contains liquid that generates aerosol at generally 20% by mass or more, preferably 30% by mass or more and more preferably 40% by mass or more, and generally 80% by mass or less, preferably 70% by mass or less and more preferably 60% by mass or less. The content within the above range allows easier suppression of a reduction in the amount of evaporated smoke flavor components and more effective suppression of "smoke flavor inhibition".

The tobacco filler of the present invention is characterised in that the tobacco filler contains a dihydrogen salt (hereinafter also abbreviated as "dihydrogen salt") of a trivalent or quadrivalent, acid having a first acid dissociation constant of 1.0 or less. Specific dihydrogen salts are riot particularly limited as far as the dihydrogen salts fulfil the condition and well-known dihydrogen salts may be appropriately used according to the purpose. Specific examples are hereinafter described. The "dihydrogen salt" means a salt containing two hydrogen ions ($H^+$) as cation and other cations are not particularly limited.

The conjugate acid forming the dihydrogen salt preferably has a first acid dissociation constant of preferably 0.8 or less and generally −1.0 or more.

The conjugate acid forming the dihydrogen salt is trivalent or quadrivalent and preferably trivalent.

Examples of cations other than hydrogen ions forming the dihydrogen salt include alkali metal ions such as lithium ion, sodium ion and potassium ion; alkaline earth metal ions such as magnesium ion and calcium ion; and ammonium ions such as ammonium ion and tetramethylammonium.

Examples of the conjugate acid forming the dihydrogen salt include pyrophosphoric acid and the like.

The acid as described above allows easier suppression of a reduction in the amount of evaporated smoke flavor components and more effective suppression of "smoke flavor inhibition".

The conjugate acid forming the dihydrogen salt has a molecular weight of generally 90 or more, preferably 120 or more and more preferably 170 or more, and generally 300 or less, preferably 250 or less and more preferably 200 or less. When the molecular weight, is within the above range, the strong acid resulting from the dissociated dihydrogen salt may appropriately suppress a reduction in the evaporation and may be retained in aerosol. As the strong acid is a highly functional acid, the strong acid may exhibit the effect even with the presence of a small amount thereof in aerosol.

Examples of the dihydrogen salt include disodium dihydrogen pyrophosphate, dipotassium dihydrogen pyrophosphate and the like.

The above dihydrogen salt allows easier suppression of a reduction in the amount of evaporated smoke flavor components and more effective suppression of "smoke flavor inhibition".

The tobacco filler of the present invention contains the dihydrogen salt at generally 0.1% by mass or more, preferably 0.25% by mass or more and more preferably 1% by mass or more, and generally 10% by mass or less and preferably 5% by mass or less. The content within the above range allows easier suppression of a reduction in the amount of evaporated smoke flavor components and more effective suppression of "smoke flavor inhibition".

The tobacco filler of the present invention contains shredded tobacco and liquid that generates aerosol. Generally, shredded tobacco contains water, and thus it can be regarded that the tobacco filler of the present invention also contains water.

The tobacco filler of the present invention contains water at generally 5% by mass or more, preferably 7.5% by mass or more and more preferably 10% by mass or more, and generally 30% by mass or less, preferably 25% by mass or less and more preferably 20% by mass or less of the whole tobacco filler. The content within the above range allows easier suppression of a reduction in the amount of evaporated smoke flavor components and more effective suppression of "smoke flavor inhibition".

EXAMPLES

The present invention is more specifically described by way of Examples. The present invention may be appropriately modified within the scope of the present invention.

Example 1, Comparative Examples 1 to 6: Effect by First Acid Dissociation Constant and Boiling Point of Conjugate Acids Forming Salts To shredded flue-cured tobacco (produced in Japan, 100 mg), 100 mg of liquid obtained by mixing propylene glycol and glycerol at 1:1 (weight ratio) was added and the salt indicated in Table 1 was added at 5% by mass in terms of the mass of the whole composition, thereby preparing a sample. Shredded tobacco used was obtained by grinding tobacco in a household mixer followed by shaking on a sieve (AS200, manufactured by Retch Technology GmbH) under the condition: amplitude−1.5 mm/"g" for 2 minutes, and had a mesh size of 0.5 mm or less.

The prepared sample was placed so as to attach to a pod dedicated to a product with the product name "Ploom®" marketed by Japan Tobacco Inc., and stored for 2 days or more under the conditions of 22° C. and humidity of 60%. It was verified that the heating temperature (during stable operation) of shredded tobacco using Ploom was about 160° C. to 170° C. by preliminary measurement using a thermocouple. As the shredded tobacco contained 13% by mass of moisture, the prepared sample may contain about 6.0% by mass of moisture.

In smoking test, the prepared pod was attached to Ploom and the amount of evaporated smoke flavor components during initial 10 puffs was measured under specified smoking conditions (55 ml/2 S, smoking interval: 30 s) on a smoking machine (Borgwaldt, RM-26). In the present experiment, the indicative component selected was nicotine, which can be easily measured as a smoke flavor component. Smoke was trapped with a Cambridge filter pad, the smoke trapped on the filter was extracted in a methanol solvent while shaking for 40 minutes and nicotine was assayed by GC-FID.

The sensory evaluation of the smoking test was carried out by four evaluators and "smoke flavor inhibition" was evaluated on a 7-grade scale of 1 to 7. In the results of the present Examples, it was regarded that the region in which the evaluated score on smoke flavor inhibition was 2 or less was a region with an excellent effect in which evaluators could sufficiently recognize the difference. In the evaluation, the value of 7 indicates that an obstacle was felt for smoking by human beings and smoking is affected. The evaluation was made and written down according to the sensation during smoking.

The physical values of salts, the amount of evaporated smoke flavor components and the results of the sensory evaluation are respectively indicated in Table 1.

TABLE 1

Type and physical values of salts and evaluation results

| | Physical values ot salt and conjugate acid that forms the salt | | | | | Amount of evaporated |
|---|---|---|---|---|---|---|
| | Classification | Name | First acid dissociation constant of conjugate acid that forms salt | Molecular weight of salt [g/mol] | Smoke flavor inhibition | smoke flavor components (nicotine, in this case) [mg/10 puffs] |
| Comparative Example 1 | No addition | No addition | — | — | 3.8 | 0.25 |

TABLE 1-continued

| Type and physical values of salts and evaluation results | | | | | | |
|---|---|---|---|---|---|---|
| | Physical values ot salt and conjugate acid that forms the salt | | | | | Amount of evaporated |
| | Classification | Name | First acid dissociation constant of conjugate acid that forms salt | Molecular weight of salt [g/mol] | Smoke flavor inhibition | smoke flavor components (nicotine, in this case) [mg/10 puffs] |
| Comparative Example 2 | Citrate salt | Tripotassium citrate | Citric acid/3.09 | 306 | 4.8 | 0.41 |
| Comparative Example 3 | | Sodium dihydrogen citrate | | 214 | 3.0 | 0.25 |
| Comparative Example 4 | Phosphate salt | Tripotassium phosphate | Phosphoric acid/1.97 | 212 | 5.7 | 0.70 |
| Comparative Example 5 | | Dipotassium hydrogen phosphate | | 174 | 4.5 | 0.55 |
| Comparative Example 6 | | Potassium dihydrogen phosphate | | 136 | 2.5 | 0.32 |
| Example 1 | Condensed phosphate salt | Disodium dihydrogen pyrophosphate | Pyrophosphoric acid/0.8 | 222 | 1.8 | 0.25 |

Figure 2:
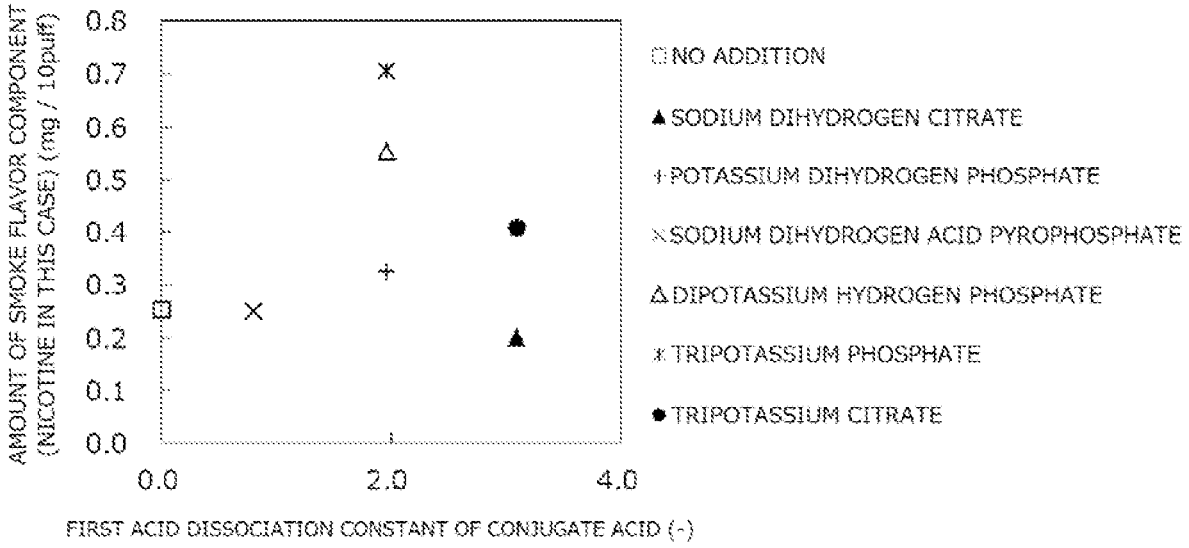
FIG. 2 is a graph illustrating the relationship between the first acid dissociation constant of the conjugate acid of the salt and the amount of evaporated smoke flavor components.

FIG. 2 indicates a graph illustrating the relationship between the first acid dissociation constant of conjugate acids forming salts and the amount of evaporated smoke flavor components. From FIG. 2, it was found that the amount of smoke flavor components is comparable between with and without addition of the dihydrogen salt. It is observed that the amount of smoke flavor components varies when more hydrogen salts or salts without hydrogen were added. From the present result, it was found that by addition of the dihydrogen salt, the amount of evaporated smoke flavor components kept constant.

Figure 3:
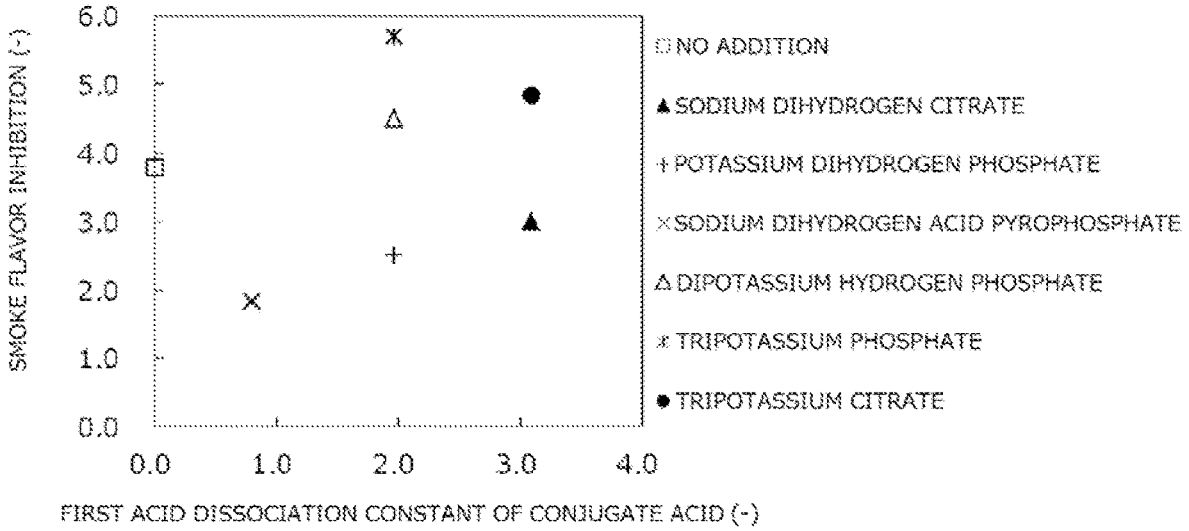
FIG. 3 is a graph illustrating the relationship between the first acid dissociation constant of the conjugate acid of the salt and smoke flavor inhibition.

FIG. 3 indicates a graph illustrating the relationship between the first acid dissociation constant of conjugate acids forming salts and smoke flavor inhibition. It was observed that smoke flavor inhibition decreased as the first acid dissociation constant of conjugate acids forming the salts decreased. Among the salts used in present Examples, disodium dihydrogen pyrophosphate had the highest effect and it is predicted that this results from the strength of the conjugate acid that forms the salt.

From the above results, it was found that by adding a dihydrogen salt formed with a conjugate acid having a first acid dissociation constant of 1.0 or less, the amount of evaporated smoke flavor components could be retained and smoke flavor inhibition could be eliminated.

Examples 2 to 4: Effect by Dihydrogen Salt Content

The test was carried out in the same manner as in previous Example except that the content, of disodium dihydrogen pyrophosphate was changed from 5% by mass in previous Example to 3% by mass or 1% by mass. In the present evaluation, only an effect on smoke flavor inhibition was focused because the amounts of evaporated smoke flavor components are equivalent.

TABLE 2

| Evaluation results when amount of sodium acid pyrophosphate added is changed | | | |
|---|---|---|---|
| | Acid name | Content [wt %] | Smoke flavor inhibition |
| Example 2 | Disodium dihydrogen pyrophosphate | 1.00 | 2.0 |
| Example 3 | | 3.00 | 2.0 |
| Example 4 | | 5.00 | 1.8 |

Figure 4:
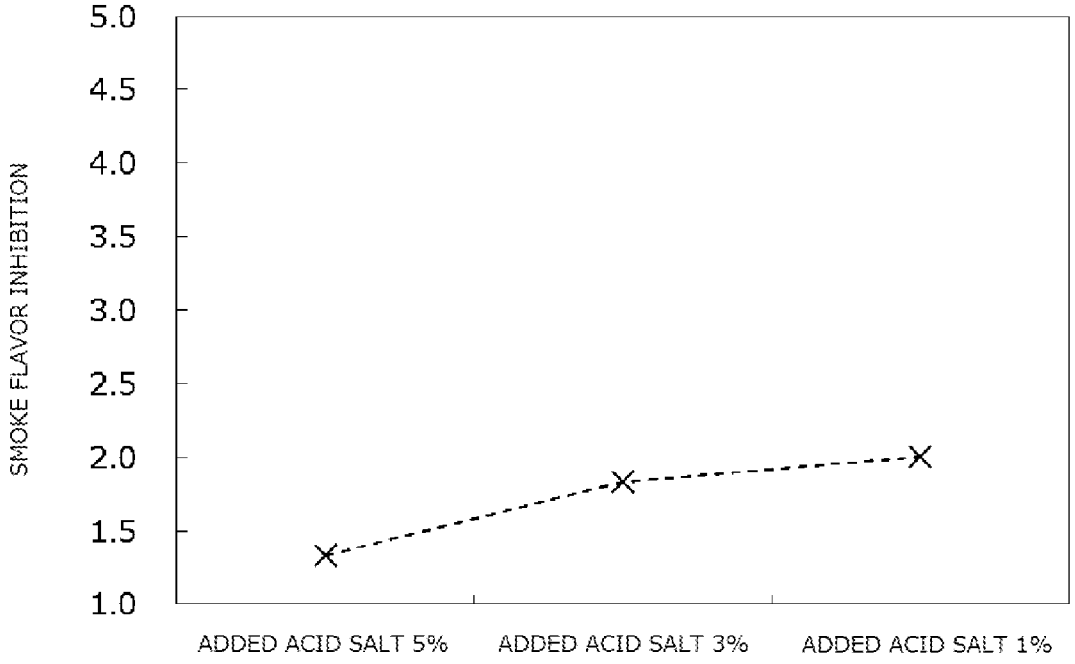
FIG. 4 is a graph illustrating the relationship between the disodium dihydrogen pyrophosphate content and smoke flavor inhibition.

FIG. 4 indicates a graph illustrating the relationship between the disodium dihydrogen pyrophosphate content and smoke flavor inhibition. From FIG. 4, it may be observed that even when the content is reduced to 1% by mass, the effect of the acid is high. Strong acids are highly functional acids, and thus it is predicted that the effect is exhibited when the acid exists in aerosol even at a low level. It may be preferable that the conjugate acid that forms the salt is stronger.

INDUSTRIAL APPLICABILITY

The tobacco filler of the present invention may fill a non-combustion smoking article for smoking.

What is claimed is:

1. A smoking article comprising:

a heater; and a pod filled with a tobacco filler, the tobacco filler comprising a shredded tobacco, and a liquid that generates aerosol, wherein the heater is configured to heat the tobacco filler at 22° C. to 350° C., the pod is equipped inside the smoking article, and the tobacco filler contains the liquid that generates aerosol at 30% by mass or more, and the tobacco filler contains a dihydrogen salt of a trivalent or quadrivalent acid having a first acid dissociation constant (pKa) of 1.0 or less at 25° C., the liquid that generates aerosol is one or more selected from the group consisting of glycerol, propylene glycol, triethylene glycol, tetraethtylene glycol, methyl stearate, dimethyl dodecanedioate, and dimethyl tetradecanedioate, and the smoking article is a non-combustion smoking article.

2. The smoking article according to claim 1, wherein the dihydrogen salt is a dihydrogen salt of pyrophosphoric acid.

3. The smoking article according to claim 1, containing the dihydrogen salt at 0.1% by mass to 10% by mass inclusive of the whole tobacco filler.

4. The smoking article according to claim 1, wherein the liquid that generates aerosol contains propylene glycol.

5. The smoking article according to claim 1, containing water at 5.0% by mass to 30% by mass inclusive of the whole tobacco filler.

6. A method for suppressing a reduction in an amount of evaporated smoke flavor components and suppressing smoke flavor inhibition in a non-combustion smoking article which has a heater and a pod equipped inside the smoking article and filled with a tobacco filler containing shredded tobacco and liquid that generates aerosol, the heater being configured to heat the tobacco filler at 22° C. to 350° C., the method comprising steps of:

adding a dihydrogen salt of a trivalent or quadrivalent acid having a first acid dissociation constant (pKa) of 1.0 or less at 25° C. to the tobacco filler wherein the tobacco filler contains the liquid that generates aerosol at 30% by mass or more; and heating the tobacco filler at 22° C. to 350° C.

7. The method according to claim 6, wherein the dihydrogen salt is a dihydrogen salt of pyrophosphoric acid.

8. The method according to claim 6, wherein the tobacco filler contains the dihydrogen salt at 0.1% by mass to 10% by mass inclusive of the whole tobacco filler.

9. The method according to claim 6, wherein the liquid that generates aerosol contains propylene glycol.

10. The method according to claim 6, wherein the tobacco filler contains water at 5.0% by mass to 30% by mass inclusive of the whole tobacco filler.

* * * * *